US008529002B2

(12) United States Patent
Kanome et al.

(10) Patent No.: US 8,529,002 B2
(45) **Date of Patent: *Sep. 10, 2013**

(54) RECORDING APPARATUS

(75) Inventors: Yuji Kanome, Yokohama (JP); Takashi Horiba, Tokyo (JP); Hikaru Watanabe, Yokohama (JP); Eiichiro Tsuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

This patent is subject to a terminal disclaimer.

(21) Appl. No.: 12/945,514

(22) Filed: Nov. 12, 2010

(65) Prior Publication Data

US 2011/0273496 A1 Nov. 10, 2011

(30) Foreign Application Priority Data

May 6, 2010 (JP) ..... 2010-106718

(51) Int. Cl.
*B41J 25/308* (2006.01)

(52) U.S. Cl.
USPC ..... 347/8; 347/20

(58) Field of Classification Search
USPC ..... 347/5, 8, 12, 13, 20, 29
See application file for complete search history.

(56) References Cited

U.S. PATENT DOCUMENTS

| | | | | |
|---|---|---|---|---|
| 2008/0018679 | A1* | 1/2008 | Kojima | 347/9 |
| 2008/0136850 | A1* | 6/2008 | Shindo | 347/8 |
| 2011/0273505 | A1* | 11/2011 | Horiba et al. | 347/17 |

FOREIGN PATENT DOCUMENTS

| | | | | |
|---|---|---|---|---|
| CN | 1647925 | A | | 8/2005 |
| JP | 11268256 | A | * | 10/1999 |
| JP | 2000-255053 | A | | 9/2000 |
| JP | 2000255053 | A | * | 9/2000 |
| JP | 2005-271316 | A | | 10/2005 |
| JP | 2005-44021 | A | | 2/2006 |
| JP | 2006-044021 | A | | 2/2006 |
| JP | 2007-191701 | A | | 8/2007 |
| JP | 2009-006682 | A | | 1/2009 |

OTHER PUBLICATIONS

English Machine Translation of JP 11-268256A.*

* cited by examiner

*Primary Examiner* — Julian Huffman
*Assistant Examiner* — Sharon A Polk
(74) *Attorney, Agent, or Firm* — Canon U.S.A., Inc. IP Division

(57) ABSTRACT

Prior to recording, the gap between ink nozzles and a sheet is set to a first gap and a humidified gas is supplied in a short time. After that, the gap is varied from the first gap to a second gap smaller than the first gap and recording is then started.

9 Claims, 5 Drawing Sheets

RECORDING APPARATUS

BACKGROUND OF THE INVENTION

1. Field of the Invention

The present invention relates to a recording apparatus including an inkjet recording head.

2. Description of the Related Art

Japanese Patent Laid-Open No. 2006-44021 discloses a method of supplying a humidified gas to the vicinity of ink nozzles in a printer including a plurality of inkjet recording heads arranged in a conveying direction to prevent the nozzles from drying. In this printer, each space between two adjacent recording heads is filled with a supporting member so that the recording heads are flush with the supporting member, thus providing a narrow gap region extending over a predetermined distance. A highly humidified gas is supplied into the gap region, thus humidifying each recording head to prevent the head from drying.

In the printer disclosed in Japanese Patent Laid-Open No. 2006-44021, a unit that holds and conveys a sheet is an attraction belt or attraction roller which holds the sheet while attracting the rear surface of the sheet using a method of electrostatic attraction or vacuum attraction. In some cases, however, poor attraction occurs depending on the kind or properties of a sheet to be used because only the rear surface of the sheet is held. Particularly, in the printer disclosed in Japanese Patent Laid-Open No. 2006-44021, since the highly humidified gas is introduced to the attraction belt or attraction roller, charges escape from the attracted surface due to humidity. Disadvantageously, holding force is remarkably reduced. As for a sheet having high stiffness and a tight curl, therefore, it is difficult to hold the sheet by attracting only the rear surface thereof, so that the sheet partially floats. The quality of an image recorded on a floating portion is degraded. If the amount of floating of the sheet is large, the sheet may come into contact with the recording heads. When the method of vacuum attraction is used to hold the sheet in the printer disclosed in Japanese Patent Laid-Open No. 2006-44021, the introduced humidified gas is sucked by vacuum before the sheet is attracted, the efficiency of humidification remarkably degrades.

As a unit configured to hold and convey a sheet in a recording location, a pair of rollers nipping the sheet therebetween may be used. However, when one of the rollers is positioned adjacent to the recording heads, the current of the introduced humidified gas is blocked by the roller. Accordingly, it is not easy to set the humidity in the whole space between the recording heads and the sheet to a desired value in a short time. Regarding the recording heads, as the recording head is farther away from the side from which the humidified gas is introduced, humidifying the recording head is later. Accordingly, it takes time until an environment in which all of the recording heads are properly moisturized is provided. This may become a factor that increases a start-up time of the apparatus.

SUMMARY OF THE INVENTION

One of the aspects of inventions provides a recording apparatus capable of securely holding a sheet irrespective of the kind and properties of the sheet when a humidified gas is introduced into the space between recording heads and the sheet to prevent ink nozzles from drying, and capable of effectively using the humidified gas.

More specifically, another aspect of present inventions provides a recording apparatus capable of supporting various kinds of sheets having various properties and also capable of providing an environment in which recording heads are properly moisturized in a short time, and having a short start-up time.

According to an aspect of the present invention, an apparatus includes a first recording head unit and a second recording head unit arranged in a conveying direction, the first and second recording head units each having ink nozzles. A conveying unit includes at least a first roller and a second roller, the rollers nipping a sheet between a recording location of the first recording head unit and a recording location of the second recording head unit, the first roller being positioned between the first and second recording head units at least when recording. A humidifying unit is configured to supply a humidified gas into a space where the ink nozzles of the first and second recording head units are exposed. An adjusting mechanism is configured to vary a gap between the ink nozzles and a level at which the sheet passes the recording locations. A control unit is configured to perform control such that prior to recording, the humidifying unit supplies the humidified gas with the gap at a first gap, the adjusting mechanism then varies the gap to a second gap smaller than the first gap, and after that, the recording unit starts recording on the sheet.

Further features of the present invention will become apparent from the following description of exemplary embodiments with reference to the attached drawings.

DESCRIPTION OF THE EMBODIMENTS

An inkjet recording apparatus according to an embodiment of the present invention will be described below. The recording apparatus according to the present embodiment is a high-speed line printer using a long continuous sheet which is longer than a print unit (called a single page or a unit image) to be repetitively printed on the sheet in a conveying direction. The recording apparatus is suitable for the field of printing a large number of sheets in, for example, a print laboratory.

Figure 1:
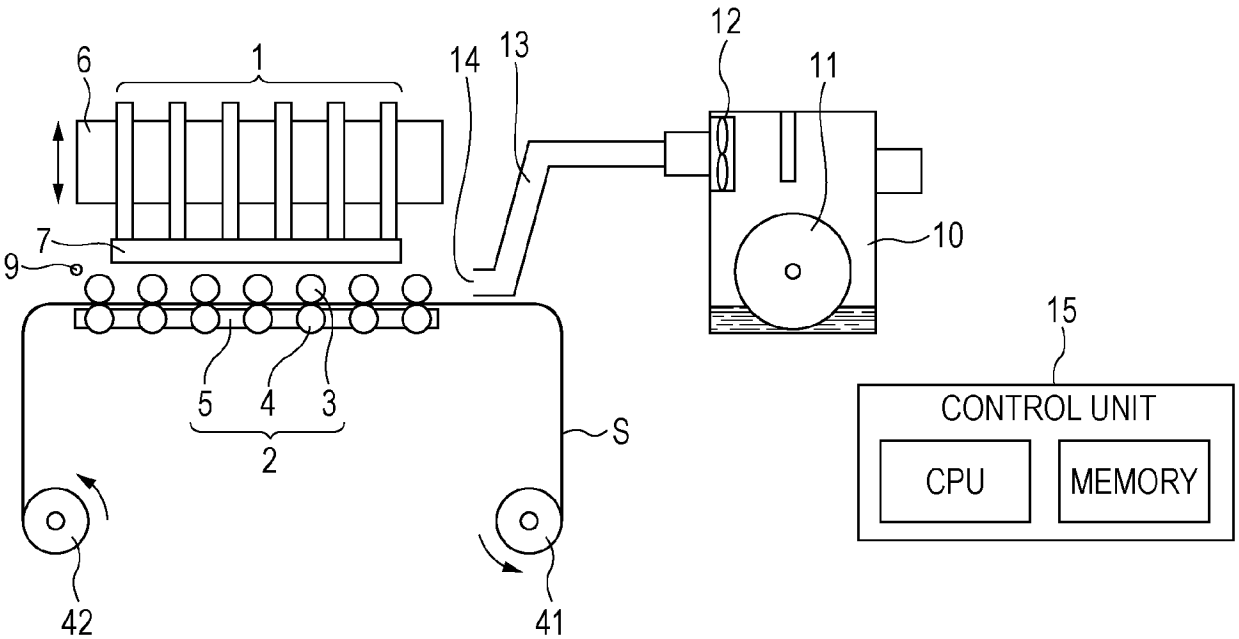
FIG. 1 is a schematic diagram of a recording apparatus in a standby mode.
Figure 2:
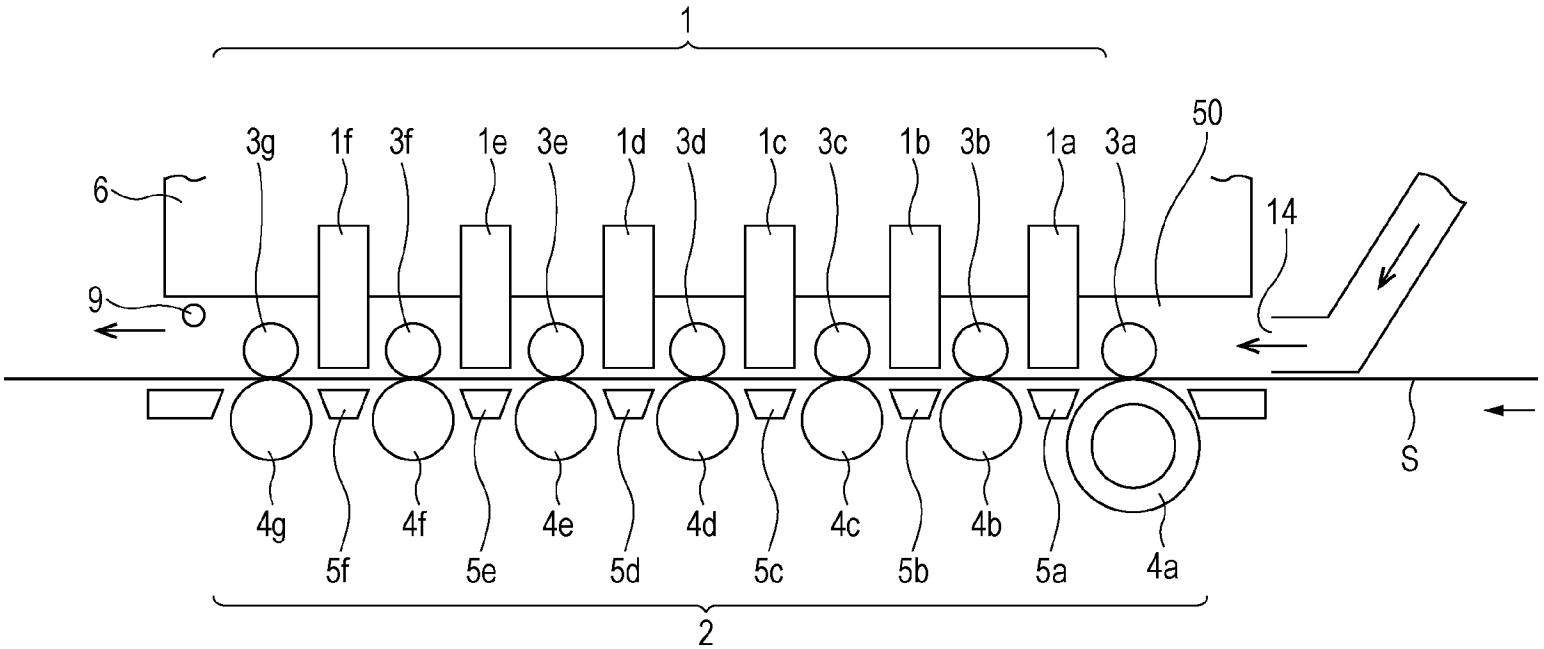
FIG. 2 is an enlarged view of a recording portion and a sheet conveying unit.

FIG. 1 is a schematic diagram of the recording apparatus according to the present embodiment in a standby mode. FIG. 2 is an enlarged view of a recording unit and a sheet conveying unit. The recording apparatus broadly includes a sheet feeding unit 41, the recording unit, the sheet conveying unit, indicated at 2, a sheet take-up unit 42, a humidifying unit 10, and a control unit 15. In an arbitrary position on a sheet conveying path, the side adjacent to the sheet feeding unit 41 will be called "upstream" and the opposite side will be called "downstream".

The sheet feeding unit 41 holds a rolled continuous sheet and feeds the sheet. An available sheet is not limited to the rolled sheet. For example, a continuous sheet having perforations arranged at unit lengths may be stacked while being folded at the perforations and may be received in the sheet feeding unit 41. The available sheet is not limited to the continuous sheet. Cut sheets may be used. The sheet take-up unit 42 takes up the continuous sheet subjected to image recording in a roll.

The recording unit includes a plurality of recording head units 1 arranged in the conveying direction. Each recording head unit 1 includes a line-type recording head including a linear array of ink nozzles of the inkjet type arranged in a range that covers a maximum recording width of a sheet to be used. In the present embodiment, six recording head units 1*a* to 1*f* (see FIG. 2) corresponding to six colors, i.e., cyan (C), magenta (M), yellow (Y), light cyan (LC), light magenta (LM), and black (K) are arranged in series. The number of colors and the number of recording heads are not limited to six. As for the inkjet type, a type using a heating element, a type using a piezoelectric element, a type using an electrostatic element, or a type using a micro-electro-mechanical system (MEMS) element may be used. Each color ink is supplied from an ink tank through an ink tube to the corresponding recording head unit. The recording head units 1 are not limited to those in the present embodiment. Each recording head unit may include a recording head and an ink tank such that the recording head is integrated with the tank.

The recording head units 1 are integrally held by a head holder 6. The head holder 6 is a plate-shaped member having six apertures into which the six recording head units 1 are inserted, and gas-tightly holds the recording head units 1 with no clearance between each recording head unit and the corresponding aperture when the recording head units 1 are inserted into the apertures. Accordingly, this arrangement allows no upward gas leakage and prevents a humidified gas, which will be described later, or ink mist generated from the nozzles upon recording from scattering upward relative to the head holder 6. The head holder 6 further includes a mechanism (adjusting mechanism) capable of moving upward and downward (in the direction indicated by arrows in FIG. 1) in order to vary the gap between the ink nozzles of each recording head unit 1 and a level at which a sheet passes a recording location. In a state in which the sheet exists in the recording location, the gap between the ink nozzles and the sheet is varied. In a state in which the sheet does not exist in the recording location, the gap between the ink nozzles and the level at which the sheet passes is varied.

The sheet conveying unit 2 includes seven pairs of rollers which nip a sheet S therebetween in the vicinities of the recording locations. Each pair of rollers includes an upper pinch roller (first roller) 3 which is driven and a lower driving roller (second roller) 4 to which driving force is applied. Referring to FIG. 2, the pinch rollers 3 include pinch rollers 3*a* to 3*g* in that order from the upstream side to the downstream side and the driving rollers 4 include driving rollers 4*a* to 4*g* in that order from the upstream side to the downstream side. These driving rollers rotate due to driving force from a driving source. The pinch rollers 3*a* to 3*g* have the same diameter. The driving rollers 4*b* to 4*g* have the same diameter. The most upstream driving roller 4*a* has a diameter larger than those of the other driving rollers. The sheet conveying unit 2 further includes a platen 5 configured to support the sheet S from below in the recording locations. Referring to FIG. 2, the platen 5 includes six segments, namely, platen segments 5*a* to 5*f*. The platen segments 5*a* to 5*f* are opposite the six recording head units 1*a* to 1*f*, respectively, such that each platen segment is positioned between two adjacent driving rollers of the rollers 4*a* to 4*g*. In other words, the driving rollers 4 are rotatably inserted in the apertures of the platen 5. Since the clearance between each driving roller 4 and the platen 5 is small, gas leakage from the clearance is little. In each of the recording locations where the recording head units 1*a* to 1*f* are opposite the platen segments 5*a* to 5*f*, respectively, the sheet S is supported by the platen segment while each of the upstream and downstream sides of the sheet is nipped between the pair of rollers. Thus, the behavior of the conveyed sheet is stabilized. Particularly, when the sheet is first introduced, the leading edge of the sheet passes a plurality of nip positions in a short period. Accordingly, the leading edge of the sheet is prevented from floating, thus leading to stabilized sheet introduction.

A nozzle cap 7 is configured to seal the ink nozzles in the standby mode where the apparatus does not perform a recording operation in order to prevent the nozzles from drying. Under the control of the control unit 15, while the gap between the ink nozzles and the level at which the sheet passes is widened by the adjusting mechanism, the nozzle cap 7 is placed under the recording unit to cover the whole of the ink nozzles. A humidity sensor 9 is configured to detect the humidity of a gas in the vicinity of the most downstream recording head unit if.

The humidifying unit 10 is configured to generate a humidified gas (air) and supply the gas into the space between the recording head units 1 and a sheet. The humidified gas prevents the ink nozzles of the recording head units 1 from drying. The present embodiment uses a vaporization humidification system in which a superabsorbent rotary member 11 rotates while absorbing water accumulated in the bottom of a housing and the air taken from the outside passes while striking the rotary member 11 to achieve humidification. The humidification system of the humidifying unit 10 is not limited to the above one. Another vaporization system, a water-spraying system, or a steam system may be used. The vaporization systems include the rotation type described above, a moisture-permeable film type, a dripping penetration type, and a capillary type. The water-spraying systems include an ultrasonic type, a centrifugal type, a high-pressure spraying type, and a double-fluid spraying type. The steam systems include a steam pipe type, an electrothermal type, and an electrode type.

The humidified gas generated by the humidifying unit 10 is fed out by a fan 12, passes a duct 13, and is then ejected from an ejection port 14. Thus, the humidified gas is supplied into a narrow space 50 between the recording unit and the sheet conveying unit 2. Part of the humidified gas ejected from the ejection port 14 flows through the space between the most upstream recording head unit 1*a* and the sheet S in the narrow space 50. After that, the humidified gas sequentially flows through the space between the pinch roller 3*b* and the head holder 6, the space between the next recording head unit 1*b* and the sheet S, and so on such that the current of the gas meanders upward and downward. In the narrow space 50, the ink nozzles of the recording head units 1 are exposed and the supplied humidified gas moisturizes the ink nozzles to prevent the ink nozzles from not ejecting inks due to drying.

The control unit 15 is configured to control the units of the recording apparatus. The control unit 15 includes a central processing unit (CPU), a memory, a controller including various control sections, an external interface, and an operation section for user input and output.

Figure 3:
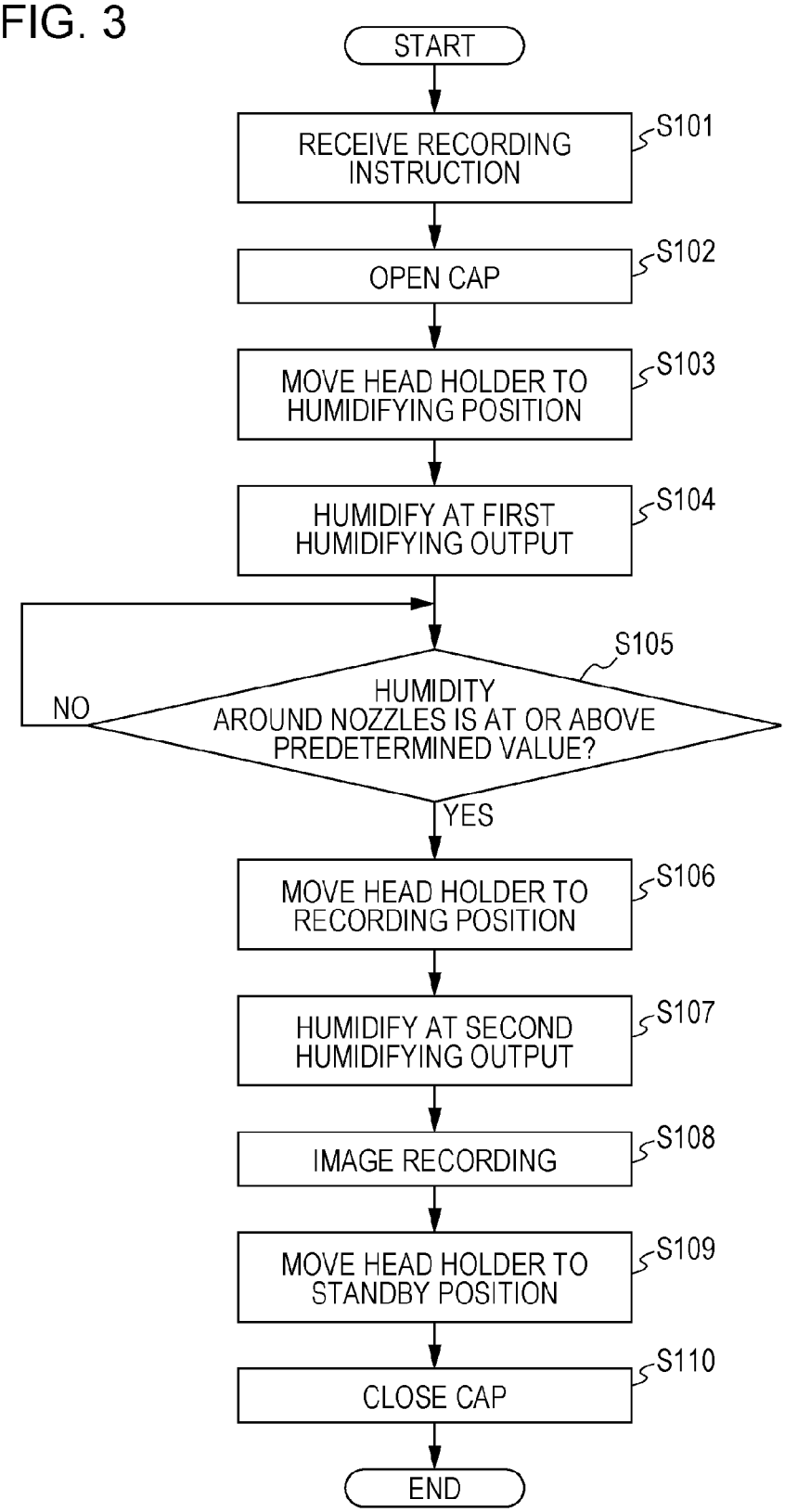
FIG. 3 is a flowchart of an operation sequence of the recording apparatus.
Figure 4:
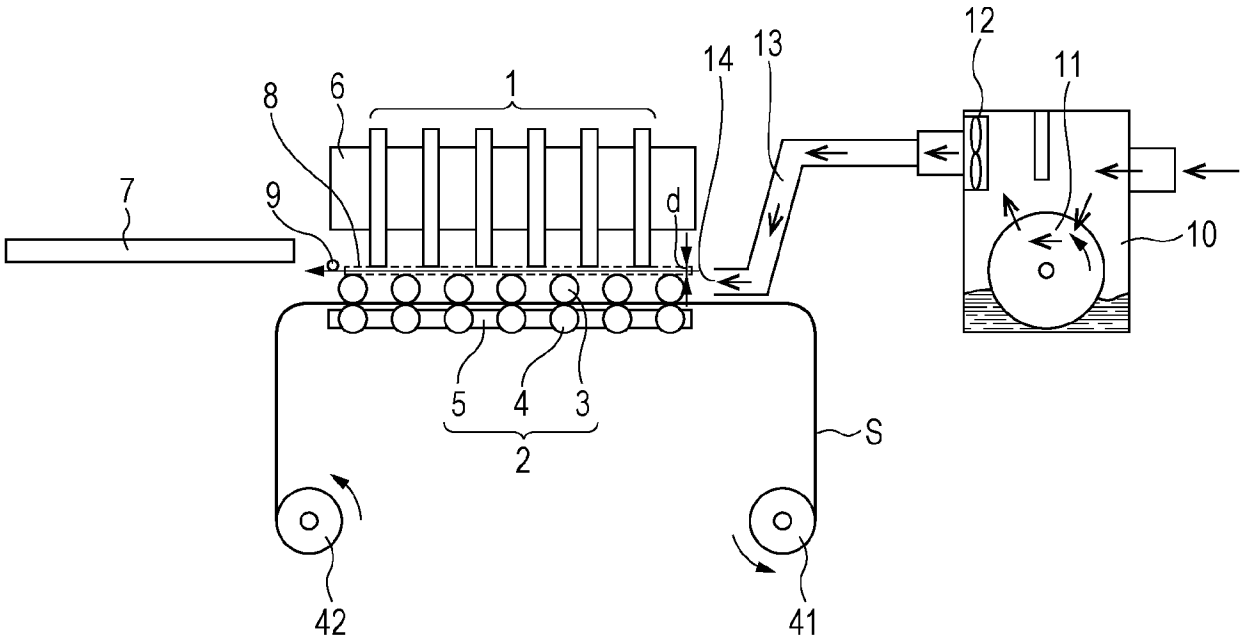
FIG. 4 is a schematic diagram of the recording apparatus in a humidifying mode prior to a recording operation.
Figure 5:
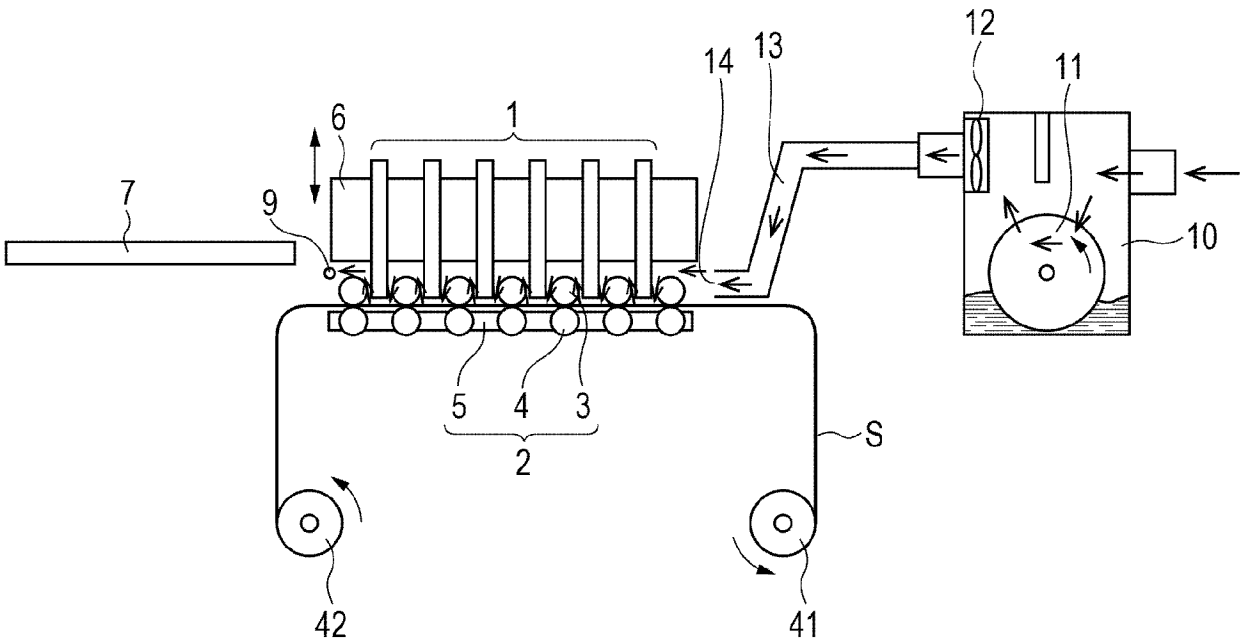
FIG. 5 is a schematic diagram of the recording apparatus in a humidifying mode during the recording operation.

A sequence for the recording operation will now be described. FIG. 3 is a flowchart of the operation sequence of the recording apparatus. This sequence is performed under the control of the control unit 15. FIG. 4 is a schematic diagram illustrating a humidifying state (second humidifying mode) prior to the recording operation of the recording apparatus. FIG. 5 is a schematic diagram illustrating another humidifying state (first humidifying mode) during the recording operation of the recording apparatus.

In the standby mode of the recording apparatus, the ink nozzles are covered with the nozzle cap 7 as illustrated in FIG. 1. The level of the head holder 6 at this time is called a "standby position". In step S101, the recording apparatus receives an instruction to start recording. In step S102, the nozzle cap 7 is released from a capping state and is then moved backward (i.e., the cap is opened). FIG. 4 illustrates a state in which the nozzle cap 7 has been moved backward.

In step S103, the adjusting mechanism moves the head holder 6 from the standby position in FIG. 1 to a humidifying position that provides a smaller gap, namely, a smaller predetermined gap (first gap).

In step S104, the humidifying unit 10 starts humidifying, so that the humidified gas is supplied from the ejection port 14. At this time, the humidifying output of the humidifying unit 10 is set to a maximum value (first humidifying output) in order to supply a large amount of humidified gas. The humidifying output is controlled by the rotational speed of the rotary member 11 and that of the fan 12.

In one embodiment, the first gap in the humidifying position is larger than the diameter of the pinch rollers 3 (having the same diameter). Satisfying this condition provides a barrier-free, straight gas flow path 8 extending in the conveying direction between the tops of the pinch rollers 3 and the surfaces of the recording head units 1 where the ink nozzles are arranged. In the straight gas flow path 8, the humidified gas supplied from the upstream side smoothly flows downstream. This straight gas flow path 8 and the supply of a large amount of the humidified gas at the maximum output of the humidifying unit 10 can bring the narrow space 50 into a desired humidified state in a short time.

In step S105, whether the humidity around the nozzles is at or above a predetermined value is determined on the basis of a result of detection by the humidity sensor 9. The sequence waits until the humidity is at or above the predetermined value. When the humidity is at or above the predetermined value, the sequence proceeds to step S106. According to an experiment, the thickness d of the gas flow path 8 is set at or above 2 mm. When the thickness d is below 2 mm, the flow resistance of the gas flow path is increased, so that the time taken for the humidity around the nozzles to reach the predetermined value remarkably increases. For example, during the start-up time of the apparatus, the time used from the start of supply of the humidified gas to the time when the humidity sensor 9 placed at the most downstream point detects the predetermined humidity is 10 seconds when the thickness d is 20 mm, 30 seconds when the thickness d is 2 mm, 100 seconds when the thickness d is 0 mm, and 400 seconds when the thickness d is −30 mm. As the thickness d decreases, the consumed time remarkably increases. Particularly, when the thickness d has a negative value (such a state is caused when the lower surfaces of the recording head units 1 are located below the tops of the pinch rollers 3), the remarkably long time is consumed. When the thickness d is too large, the time taken for the adjusting mechanism to move the head holder 6 is increased. The upper limit of the thickness d is to be 50 mm. In the present embodiment, the thickness d is set to 20 mm. As described above, the gap (first gap) between the ink nozzles and the sheet in the recording locations in the humidifying position is larger than at least the diameter of the pinch rollers 3. In one embodiment, the first gap is larger than the diameter of the pinch rollers 3 by 2 to 50 mm.

In step S106, the adjusting mechanism moves the head holder 6 from the humidifying position illustrated in FIG. 4 to a recording position providing a further smaller gap, namely, a further smaller predetermined gap (second gap) illustrated in FIGS. 5 and 2. In the recording position, the nozzle arrays of the recording head units 1 are close to the sheet S to provide a gap suitable for ink ejection and recording. In this embodiment, the second gap is set to 1 mm. At this time, as illustrated in FIG. 2, the recording head units 1*a* to 1*f* enter the spaces between the pinch rollers 3*a* to 3*g* such that the pinch rollers and the recording head units are alternately arranged in the conveying direction. In other words, one pinch roller 3 is placed between two adjacent arbitrary recording head units (first and second recording head units) in the conveying direction.

In step S107, the output of the humidifying unit 10 is changed such that the first humidifying output is switched to a second humidifying output lower than the first humidifying output. In step S108, recording is started. During recording, the humidified gas is continuously supplied while the second humidifying output is being kept. The humidified gas ejected from the ejection port 14 flows in the narrow space 50 while the gas current meandering upward and downward. Accordingly, it takes long time until the humidity in the entire narrow space 50 from the most upstream point to the most downstream point reaches the predetermined value. However, since the humidity around the nozzles is previously set to the predetermined value (steps S102 to S105), a minimum supply of the humidified gas for maintaining the predetermined humidity around the nozzles can maintain the humidity in the narrow space 50. During the recording operation, humidification is performed at the second humidifying output lower than the first humidifying output. This reduces the power consumption and also reduces the consumption of water in the humidifying unit 10. If flow speed around the ink nozzles is too high during recording, the high flow speed affects the flying of ink ejected from the nozzles, thus degrading the precision of landing of ink. In terms of the purpose to prevent the degradation of the precision of landing, it is effective to reduce the output of the humidifying unit 10 during recording in order to lower the flow speed of the humidified gas.

When the intended recording of all images is completed in step S108, the sequence proceeds to step S109. In step S109, the adjusting mechanism returns the head holder 6 from the recording position to the initial standby position illustrated in FIG. 1. The nozzle cap 7 is moved to a capping position when the recording unit to cover the ink nozzles (i.e., the cap is closed). The sequence terminates in this manner.

In the recording apparatus according to the present embodiment, a sheet is securely held by the pairs of rollers. Even when the sheet has a high stiffness and a tight curl, the floating of the sheet can be therefore prevented. The recording apparatus can support various kinds of sheets having various properties and perform recording with high image quality. In addition, since an environment in which the recording heads are properly moisturized can be made in a short time. Thus, the recording apparatus having a short start-up time can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-106718 filed May 6, 2010, which is hereby incorporated by reference herein in its entirety.

What is claimed is:

1. An apparatus comprising:

a recording unit including a first recording head unit and a second recording head unit arranged in a conveying direction, the first and second recording head units each having ink nozzles;

a conveying unit including a first roller and a second roller, the rollers nipping a sheet between a recording location of the first recording head unit and a recording location of the second recording head unit, the first roller being positioned between the first and second recording head units at least when recording;

a humidifying unit configured to supply humidified gas into a space where the ink nozzles of the first and second recording head units are exposed;

an adjusting mechanism configured to vary a gap between the ink nozzles and a level at which the sheet passes the recording locations; and a control unit configured to perform control such that prior to recording, the humidifying unit supplies the humidified gas with the gap at a first gap, the adjusting mechanism then varies the gap to a second gap smaller than the first gap, and then the recording unit starts recording on the sheet.

2. The apparatus according to claim 1, wherein the second gap is smaller than a diameter of the first roller.

3. The apparatus according to claim 2, wherein the first gap is larger than the diameter of the first roller.

4. The apparatus according to claim 3, wherein the first gap is larger than the diameter of the first roller by approximately 2 to 50 mm.

5. The apparatus according to claim 1, wherein part of the humidified gas flows through a gap between the first recording head unit and the sheet and then flows through a gap between the second recording head unit and the sheet in the space.

6. The apparatus according to claim 1, further comprising:

a sensor configured to detect humidity of the gas in a vicinity of the second recording head unit, wherein the control unit performs control based on a result of detection by the sensor so that the gap is varied from the first gap to the second gap.

7. The apparatus according to claim 1, wherein the humidified gas is continuously supplied during recording.

8. The apparatus according to claim 7, wherein the control unit performs control such that an output of the humidifying unit when the humidified gas is supplied at the first gap is larger than that when the humidified gas is supplied at the second gap.

9. The apparatus according to claim 1, further comprising:

a nozzle cap configured to cover the ink nozzles, wherein the control unit performs control such that in a standby mode, the adjusting mechanism varies the gap to a gap larger than the first gap, the nozzle cap is placed under the recording unit, and the ink nozzles are covered with the nozzle cap.

* * * * *